US009108813B2

(12) United States Patent
Goto et al.

(10) Patent No.: US 9,108,813 B2
(45) Date of Patent: Aug. 18, 2015

(54) IMAGE FORMING APPARATUS AND RECORDING-MATERIAL-TRANSPORTING DEVICE

(71) Applicant: FUJI XEROX CO., LTD., Tokyo (JP)

(72) Inventors: Yasunobu Goto, Kanagawa (JP); Makio Uehara, Kanagawa (JP); Hiromitsu Tomioka, Kanagawa (JP); Hiroyuki Momiyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/283,705

(22) Filed: May 21, 2014

(65) Prior Publication Data

US 2015/0104203 A1 Apr. 16, 2015

(30) Foreign Application Priority Data

Oct. 10, 2013 (JP) ..... 2013-213116

(51) Int. Cl.
*B65H 5/06* (2006.01)
*G03G 15/00* (2006.01)

(52) U.S. Cl.
CPC ..... *B65H 5/062* (2013.01); *G03G 15/6529* (2013.01); *B65H 2511/528* (2013.01); *B65H 2601/11* (2013.01); *B65H 2601/111* (2013.01)

(58) Field of Classification Search
CPC ..... B65H 2511/528; B65H 2601/11; B65H 2601/111; B65H 5/062
USPC ..... 271/264
See application file for complete search history.

(56) References Cited

U.S. PATENT DOCUMENTS

| | | | | |
|---|---|---|---|---|
| 5,727,784 | A * | 3/1998 | Sagawa | 271/265.01 |
| 6,139,011 | A * | 10/2000 | Huang et al. | 271/274 |
| 7,092,646 | B2 * | 8/2006 | Schroath et al. | 399/21 |
| 2003/0122296 | A1 * | 7/2003 | Kim | 271/3.14 |
| 2005/0158091 | A1 * | 7/2005 | Oya et al. | 399/367 |
| 2008/0048390 | A1 * | 2/2008 | Gutierrez-Vazquez et al. | 271/256 |
| 2009/0102118 | A1 * | 4/2009 | Shibano | 271/265.03 |
| 2010/0194026 | A1 * | 8/2010 | Iguchi | 271/3.15 |
| 2013/0108284 | A1 * | 5/2013 | Takata | 399/21 |

FOREIGN PATENT DOCUMENTS

JP A-2003-81484 3/2003

* cited by examiner

*Primary Examiner* — Ernesto Suarez
(74) *Attorney, Agent, or Firm* — Oliff PLC

(57) ABSTRACT

An image forming apparatus includes an image forming section that forms an image, a transport path section along which a recording material that is yet to undergo or has undergone image formation performed by the image forming section is transported, a transport unit that is provided in the transport path section and transports the recording material while nipping the recording material, an operated portion that is operated by a user and activates the transport unit such that the recording material is removed from the transport unit, and a notification unit that notifies a completion of the operation of the operated portion on the basis of a position of the recording material that is removed from the transport unit by the user's operation of the operated portion.

3 Claims, 4 Drawing Sheets

IMAGE FORMING APPARATUS AND RECORDING-MATERIAL-TRANSPORTING DEVICE

CROSS-REFERENCE TO RELATED APPLICATIONS

This application is based on and claims priority under 35 USC 119 from Japanese Patent Application No. 2013-213116 filed Oct. 10, 2013.

BACKGROUND

Technical Field

The present invention relates to an image forming apparatus and a recording-material-transporting device.

SUMMARY

According to an aspect of the invention, there is provided an image forming apparatus including an image forming section that forms an image, a transport path section along which a recording material that is yet to undergo or has undergone image formation performed by the image forming section is transported, a transport unit that is provided in the transport path section and transports the recording material while nipping the recording material, an operated portion that is operated by a user and activates the transport unit such that the recording material is removed from the transport unit, and a notification unit that notifies a completion of the operation of the operated portion on the basis of a position of the recording material that is removed from the transport unit by the user's operation of the operated portion.

BRIEF DESCRIPTION OF THE DRAWINGS

An exemplary embodiment of the present invention will be described in detail based on the following figures, wherein.

DETAILED DESCRIPTION

An exemplary embodiment of the present invention will now be described in detail with reference to the accompanying drawings.

Figure 1:
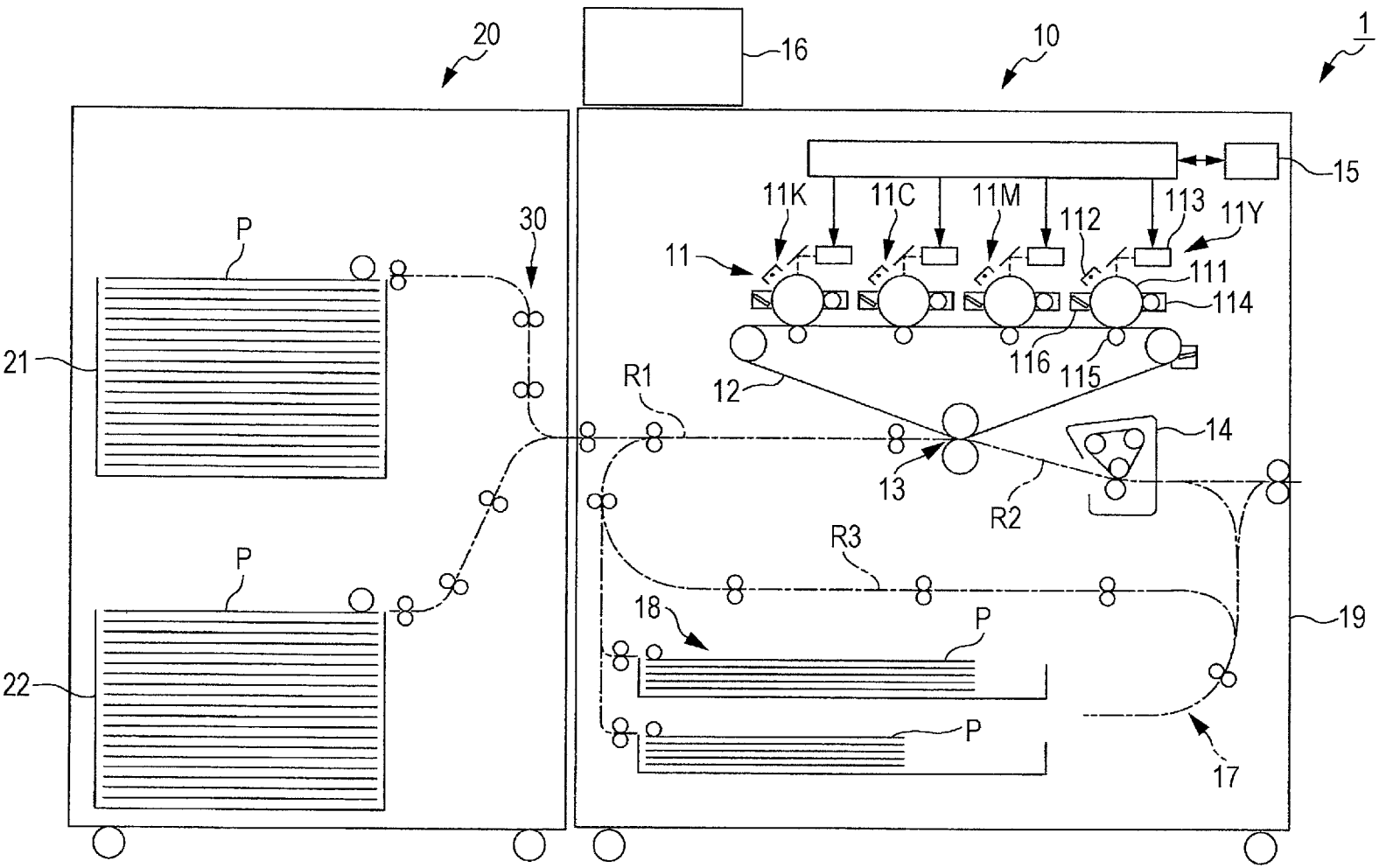
FIG. 1 illustrates an overall configuration of an image forming apparatus according to the exemplary embodiment.

FIG. 1 illustrates an overall configuration of an image forming apparatus 1 according to the exemplary embodiment.

The image forming apparatus 1 illustrated in FIG. 1 includes an image forming section 10 that forms a color toner image on a sheet P (a recording material) by, for example, an electrophotographic method; and a sheet feeding section 20 that contains a large number of sheets P and feeds each of the sheets P to the image forming section 10.

While the exemplary embodiment concerns a case where the image forming section 10 forms an image by an electrophotographic method, the image forming section 10 may be an inkjet printer, for example.

The image forming section 10 includes image forming units 11 that form respective toner images, an intermediate transfer belt 12 that carries and transports the toner images formed by the image forming units 11, a second transfer unit 13 that transfers the toner images on the intermediate transfer belt 12 to a sheet P, a fixing device 14 that fixes the toner images on the sheet P, a general controller 15 that generally controls the image forming apparatus 1, a user interface (UI) 16 that accepts instructions and provides information, sheet transport paths 17 along which the sheet P is transported, sheet storing units 18 that each store plural sheets P, and a housing 19 that covers the foregoing elements included in the image forming section 10.

The image forming units 11 are arranged in a so-called tandem manner. The image forming units 11 include an image forming unit 11Y (for yellow), an image forming unit 11M (for magenta), an image forming unit 11C (for cyan), and an image forming unit 11K (for black) that form toner images in respective colors by an electrophotographic method.

As is seen in the image forming unit 11Y, for example, illustrated in FIG. 1, each of the image forming units 11 includes a rotatable photoconductor drum 111 and the following elements provided around the photoconductor drum 111: a charging device 112 that charges the photoconductor drum 111, an exposure device 113 that forms an electrostatic latent image on the photoconductor drum 111 by applying light to the photoconductor drum 111, a developing device 114 that visualizes the electrostatic latent image on the photoconductor drum 111 with toner into a toner image, a first transfer device 115 that transfers the toner image formed on the photoconductor drum 111 with the toner having a corresponding one of the colors to the intermediate transfer belt 12, and a drum cleaning device 116 that removes residual toner from the photoconductor drum 111.

The intermediate transfer belt 12 carries the toner images that have been formed in the respective colors by the respective image forming units 11 and have been sequentially transferred thereto (in a first transfer operation). The second transfer unit 13 transfers the toner images on the intermediate transfer belt 12 to a sheet P at a time (in a second transfer operation).

The fixing device 14 fixes the toner images on the sheet P that are obtained in the second transfer operation performed by the second transfer unit 13 to the sheet P. The fixing device 14 fixes the toner images on the sheet P to the sheet P by applying pressure and heat to the sheet P.

The general controller 15 accepts image data and printing instructions for image formation from a personal computer (PC) or the like (not illustrated) that is connected to the image forming section 10 over a network or the like. The general controller 15 also controls operations of the elements included in the image forming section 10 and in the sheet feeding section 20, which is connected to the image forming section 10.

The user interface (UI) 16 includes a display panel such as a liquid-crystal touch panel. The UI 16 outputs instructions given by the user to the general controller 15 and provides information acquired from the general controller 15 to the user.

The sheet transport paths 17 include a first sheet transport path R1 along which the sheet P is transported toward the second transfer unit 13, a second sheet transport path R2 along which the sheet P that has passed through the second transfer unit 13 is transported, a third sheet transport path R3 along which the sheet P is reversed and is transported toward the second transfer unit 13 again, and other associated elements.

The sheet storing units 18 are provided in the image forming section 10. The sheet storing units 18 feed each of the sheets P stored therein toward the second transfer unit 13.

The housing 19 supports and houses the image forming units 11, the intermediate transfer belt 12, the second transfer unit 13, the fixing device 14, the general controller 15, the sheet transport paths 17, and the sheet storing units 18.

The sheet feeding section 20 is a so-called high-capacity feeder (HCF) and feeds each of the sheets P to the image forming section 10 at a high speed. The sheet feeding section 20 includes a first sheet container 21 containing plural sheets P, a second sheet container 22 provided below the first sheet container 21 and containing plural sheets P, and a sheet transport portion 30 that transports each of the sheets P that is fed from the first sheet container 21 or the second sheet container 22 toward the image forming section 10.

The first sheet container 21 and the second sheet container 22 are drawable. For example, sheets P are supplied to the first sheet container 21 with the first sheet container 21 drawn out of the body of the sheet feeding section 20.

An image forming operation performed by the image forming apparatus 1 will now be described.

When image data generated by a PC or the like (not illustrated) is accepted by the general controller 15 of the image forming section 10, the general controller 15 processes the image data. The processed image data is output to each of the exposure devices 113. The exposure device 113 that has acquired the image data selectively applies light to a corresponding one of the photoconductor drums 111 that has been charged by a corresponding one of the charging devices 112, whereby an electrostatic latent image is formed on the photoconductor drum 111. The electrostatic latent image thus formed on the photoconductor drum 111 is developed into a toner image in, for example, black (K) by a corresponding one of the developing devices 114.

Meanwhile, in accordance with the timing of the above image forming operation, a sheet P is fed from any of the sheet storing units 18 of the image forming section 10 and the first sheet container 21 and the second sheet container 22 of the sheet feeding section 20 to the first sheet transport path R1. The sheet P is transported to the second transfer unit 13 in accordance with the timing of rotation of the intermediate transfer belt 12. Thus, the toner images formed on the respective photoconductor drums 111 are transferred to the sheet P by the second transfer unit 13. Subsequently, the sheet P having the toner images transferred thereto is transported along the second sheet transport path R2 and undergoes a fixing operation in the fixing device 14. If so-called duplex printing is to be performed in which the sheet P having an image formed on one side thereof by the image forming section 10 undergoes another image forming operation to be performed on the other side thereof, the sheet P is transported along the third sheet transport path R3, thereby being reversed. Then, the sheet P is transported to the second transfer unit 13 again, where the sheet P undergoes another image forming operation.

In the sheet feeding section 20, for example, a sheet P may be stuck (jammed) in the sheet transport portion 30. In such a case, if the sheet feeding section 20 and the image forming section 10 are forcibly disconnected from each other by, for example, moving the sheet feeding section 20, the sheet P may be torn with part thereof being left in the sheet feeding section 20 or in the image forming section 10. If, for example, the first sheet container 21 is drawn out of the sheet feeding section 20 with the sheet P being caught in the sheet transport portion 30, the sheet P may be torn likewise with part thereof being left in the sheet feeding section 20 or in the image forming section 10.

In a known image forming apparatus, an operation handle is provided to the sheet transport portion 30, for example. In such a case, the jammed sheet P is moved by rotating the operation handle, whereby the jammed sheet P is removed. In such a known image forming apparatus, however, if a sheet P is jammed at a position where the sheet P is not directly observable or is difficult to observe, the user cannot tell how much the operation handle needs to be rotated so as to remove the jammed sheet P. Therefore, for example, the user has to open the sheet transport portion 30 and check the state of the sheet P while rotating the operation handle.

To avoid such a situation, in the image forming apparatus 1 according to the exemplary embodiment, the sheet transport portion 30 is provided with a notification mechanism 40 to be described below. Thus, when the user removes the jammed sheet P, the user is notified of the completion of the removal of the jammed sheet P. Details of the sheet transport portion 30 will now be described.

Figure 2:
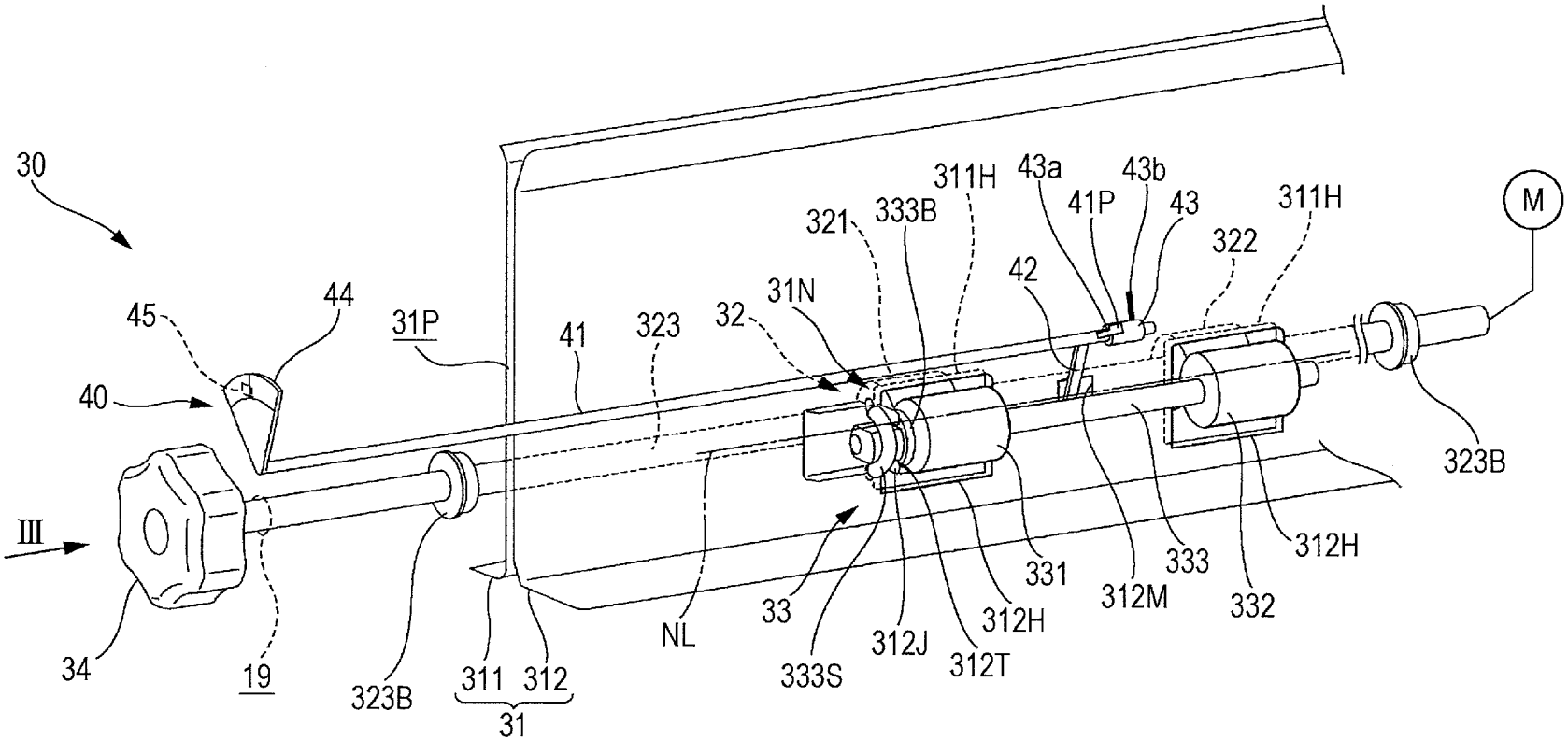
FIG. 2 illustrates a sheet transport portion according to the exemplary embodiment.

FIG. 2 illustrates the sheet transport portion 30 according to the exemplary embodiment.

Figure 3B:
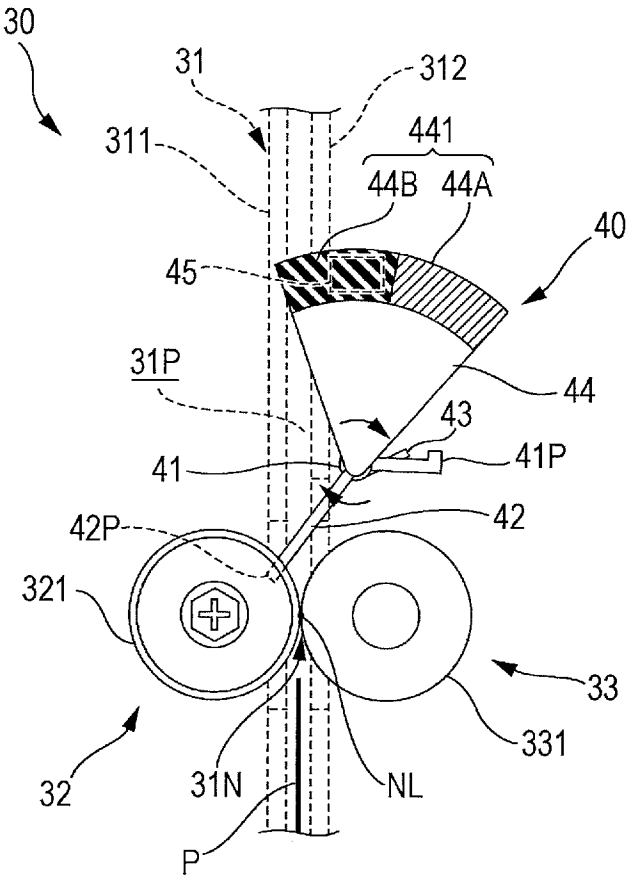
FIGS. 3A and 3B illustrate the sheet transport portion seen in a direction of an arrow III illustrated in FIG. 2.
Figure 3A:
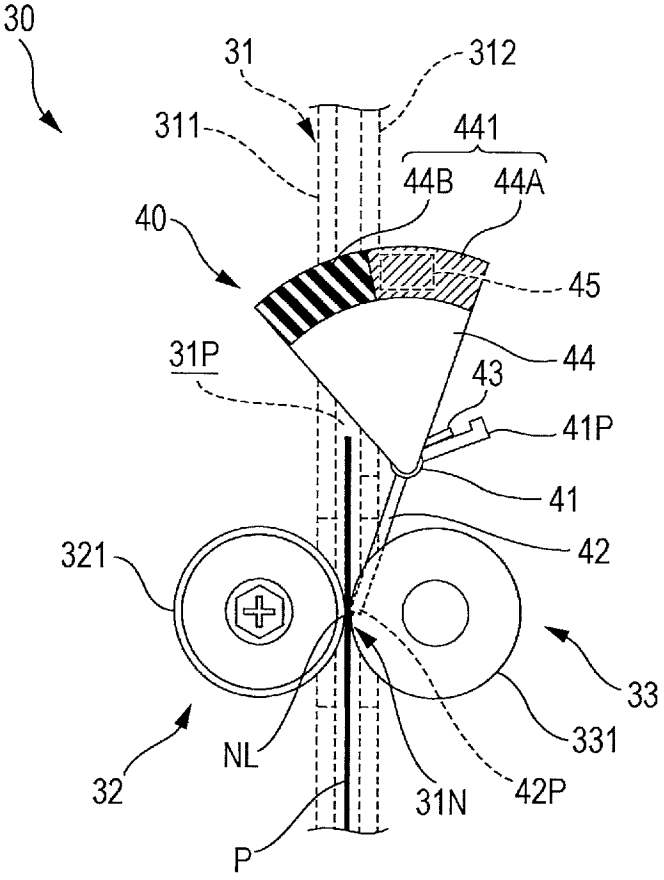

FIGS. 3A and 3B illustrate the sheet transport portion 30 seen in a direction of an arrow III illustrated in FIG. 2. In FIGS. 3A and 3B, an operation handle 34 to be described below is not illustrated.

As illustrated in FIG. 2, the sheet transport portion 30 includes a sheet transport pathway 31 along which the sheet P is transported, a transport roller unit 32 provided on the sheet transport pathway 31 and that transports the sheet P in the sheet transport pathway 31 toward the downstream side in a direction of sheet transport, a transport counter roller unit 33 provided against the transport roller unit 32, the operation handle 34 to be operated by the user when the sheet P jammed in the sheet transport portion 30 is to be removed, and the notification mechanism 40 that notifies the user of the completion of the removal of the jammed sheet P.

The sheet transport pathway 31 (a transport path section) includes a first transport member 311 and a second transport member 312 that faces the first transport member 311 with a gap interposed therebetween. The gap is of a size that allows the sheet P to be transported therethrough. That is, the sheet transport pathway 31 forms a sheet passage 31P defined between the first transport member 311 and the second transport member 312 and through which the sheet P passes.

The first transport member 311 has a plate-like shape with a width larger than the width of the sheet P to be transported (the length of the sheet P in a direction intersecting the direction of sheet transport). The first transport member 311 has two openings 311H that allow a first transport roller 321 and a second transport roller 322, which are included in the transport roller unit 32 and will be described below, to project therefrom into the sheet passage 31P such that a portion of the first transport roller 321 and a portion of the second transport roller 322 are located in the sheet passage 31P.

Likewise the first transport member 311, the second transport member 312 has a plate-like shape with a width larger than the width of the sheet P to be transported. The second transport member 312 has two openings 312H that allow a first transport counter roller 331 and a second transport counter roller 332, which are included in the transport counter roller unit 33 and will be described below, to project therefrom into the sheet passage 31P such that a portion of the first transport counter roller 331 and a portion of the second transport counter roller 332 are located in the sheet passage 31P. The second transport member 312 also has a movable member opening 312M that allows a movable member 42, which is included in the notification mechanism 40 and will be described below, to advance into and retract from the sheet passage 31P.

The second transport member 312 includes holding portions 312J provided on a side thereof opposite the sheet passage 31P and that hold the transport counter roller unit 33. The holding portions 312J have respective grooves 312T each defined by a portion of the second transport member 312 that is folded upright. The holding portions 312J hold respective bearings 333B to be described below in the respective grooves 312T in such a manner as to allow the bearings 333B to move in a direction toward the respective openings 312H while preventing the bearings 333B from moving in a direction along the major surface of the second transport member 312.

The transport roller unit 32 includes the first transport roller 321, the second transport roller 322 provided in parallel with the first transport roller 321, and a transport shaft 323 serving as a common axis of rotation of the first transport roller 321 and the second transport roller 322.

The first transport roller 321 is a columnar member and is rotatable about the transport shaft 323 serving as the axis of rotation thereof. Thus, the first transport roller 321 transports the sheet P with the outer circumferential surface thereof being in contact with the sheet P. Likewise the first transport roller 321, the second transport roller 322 is a columnar member and is rotatable about the transport shaft 323 serving as the axis of rotation thereof. Thus, the second transport roller 322 transports the sheet P with the outer circumferential surface thereof being in contact with the sheet P. The first transport roller 321 and the second transport roller 322 only need to be capable of transporting the sheet P while being in contact with the sheet P and may be made of a material such as plastic or rubber.

The first transport roller 321 and the second transport roller 322 are fixed to the transport shaft 323. The transport shaft 323 is rotatably supported by bearings 323B provided at two respective axial ends thereof.

The transport shaft 323 is connected to a driving motor M. When the transport shaft 323 is driven by the driving motor M and thus rotates, the first transport roller 321 and the second transport roller 322 rotate. The transport shaft 323 is provided with the operation handle 34 as illustrated in FIG. 2. The operation handle 34 will be described in detail separately below.

The transport counter roller unit 33 includes the first transport counter roller 331, the second transport counter roller 332 provided in parallel with the first transport counter roller 331, and a counter shaft 333 serving as a common axis of rotation of the first transport counter roller 331 and the second transport counter roller 332.

The first transport counter roller 331 is a columnar member and is provided against the first transport roller 321. The sheet P is nipped between the first transport counter roller 331 and the first transport roller 321. While the sheet P is transported, the first transport counter roller 331 rotates about the counter shaft 333 serving as the axis of rotation thereof with the sheet P being nipped between the first transport counter roller 331 and the first transport roller 321.

The second transport counter roller 332 is a columnar member and is provided against the second transport roller 322. The sheet P is nipped between the second transport counter roller 332 and the second transport roller 322. While the sheet P is transported, the second transport counter roller 332 rotates about the counter shaft 333 serving as the axis of rotation thereof with the sheet P being nipped between the second transport counter roller 332 and the second transport roller 322.

The first transport counter roller 331 and the second transport counter roller 332 only need to be capable of transporting the sheet P while being in contact with the sheet P and may be made of a material such as plastic or rubber.

The first transport counter roller 331 and the second transport counter roller 332 are fixed to the counter shaft 333. The counter shaft 333 is rotatably supported by the bearings 333B provided at two respective axial ends thereof. As illustrated in FIG. 2, the bearings 333B are provided with respective elastic members such as coil springs 333S. Receiving the spring forces exerted by the coil springs 333S via the bearings 333B, the counter shaft 333 presses the first transport counter roller 331 and the second transport counter roller 332 against the first transport roller 321 and the second transport roller 322, respectively.

Hereinafter, as illustrated in FIGS. 3A and 3B for example, an area where the first transport counter roller 331 and the first transport roller 321 are provided against each other and the sheet P is to be nipped therebetween and an area where the second transport counter roller 332 and the second transport roller 322 are provided against each other and the sheet P is nipped therebetween are each referred to as sheet nipping part 31N. In the exemplary embodiment, as illustrated in FIG. 2 and FIGS. 3A and 3B, a line extending in the sheet transport pathway 31 orthogonally to the direction of sheet transport while passing through the sheet nipping parts 31N is denoted as virtual nip line NL.

In the exemplary embodiment, the transport roller unit 32 (the first transport roller 321 and the second transport roller 322) and the transport counter roller unit 33 (the first transport counter roller 331 and the second transport counter roller 332) function as exemplary transport units.

As illustrated in FIG. 2, the operation handle 34 (an operated portion) is fixed to an end of the transport shaft 323. When the user rotates the operation handle 34, the transport shaft 323 rotates. For example, when the operation handle 34 is rotated with a sheet P being nipped at the sheet nipping parts 31N, the transport roller unit 32 rotates, whereby the sheet P is moved. By rotating the operation handle 34, the sheet P is removed from the sheet nipping parts 31N.

The notification mechanism 40 (a notification unit) includes a notification shaft 41 extending along the transport shaft 323, the movable member 42 provided on the notification shaft 41, a torsion spring 43 that applies a spring force to the notification shaft 41, and a notification plate 44 provided at an end of the notification shaft 41. The notification mechanism 40 further includes a window 45 provided at a position of the housing 19 that faces the notification plate 44.

One end of the notification shaft 41 is positioned near the second transport counter roller 332. The other end of the notification shaft 41 is positioned near the operation handle 34. The notification shaft 41 is rotatably supported by bearings (not illustrated). The notification shaft 41 has a projection 41P at the end thereof positioned near the second transport counter roller 332. One end 43*a* (to be described below) of the torsion spring 43 is hooked on the projection 41P.

The movable member 42 (a movable portion) according to the exemplary embodiment is positioned between the first transport counter roller 331 and the second transport counter roller 332. The movable member 42 projects outward in the radial direction of the notification shaft 41. The movable member 42 rotates about the notification shaft 41 serving as an axis of rotation thereof, thereby advancing into or retracting from the sheet passage 31P through the movable member opening 312M provided in the second transport member 312.

As illustrated in FIGS. 3A and 3B, the movable member 42 is provided such that a tip 42P thereof moves along a locus of rotation that passes through a position corresponding to the sheet nipping parts 31N in the direction of sheet transport and such that the locus of rotation of the tip 42P intersects the virtual nip line NL. Hence, in a state where the sheet P is nipped at the sheet nipping parts 31N as illustrated in FIG. 3A, the tip 42P is on the virtual nip line NL since the tip 42P is in contact with one side of the sheet P. On the other hand, in a state where the sheet P is out of the sheet nipping parts 31N as illustrated in FIG. 3B, the tip 42P of the movable member 42 is at a position off the virtual nip line NL.

As illustrated in FIG. 2, the torsion spring 43 is made of a piece of wire having the end 43*a* and another end 43*b*. The torsion spring 43 is provided around the notification shaft 41 such that the notification shaft 41 extends therethrough. The end 43*a* of the torsion spring 43 is hooked on the projection 41P of the notification shaft 41. The end 43*b* of the torsion spring 43 is pressed against the second transport member 312. As illustrated in FIGS. 3A and 3B, the torsion spring 43 applies a rotational force to the notification shaft 41 such that the movable member 42 moves toward the first transport member 311.

As illustrated in FIG. 2, the notification plate 44 (a notification member) is provided at the end of the notification shaft 41 that is nearer to the operation handle 34. The notification plate 44 according to the exemplary embodiment has a sectoral shape spreading from the notification shaft 41. As described above, the movable member 42 is provided on the notification shaft 41. Hence, in conjunction with the notification shaft 41 that rotates with the movement of the movable member 42 that comes into contact with or moves away from the sheet P, the notification plate 44 rotates about the notification shaft 41 serving as an axis of rotation thereof.

As illustrated in FIGS. 3A and 3B, the notification plate 44 includes a colored portion 441 that is divided into two sections having different colors in the direction of rotation of the notification shaft 41. In the exemplary embodiment, the colored portion 441 includes a first colored section 44A colored in, for example, red and a second colored section 44B colored in, for example, blue. Either the first colored section 44A or the second colored section 44B faces the window 45 in accordance with the angle of rotation of the notification plate 44.

As illustrated in FIG. 2, the window 45 is an opening provided in the housing 19 and has a rectangular shape in the exemplary embodiment. The window 45 allows the colored portion 441 of the notification plate 44 to be observed from the outside of the housing 19. In the exemplary embodiment, the window 45 (the notification plate 44) and the operation handle 34 are provided adjacent to each other. In the exemplary embodiment, the user is allowed to visually observe the colored portion 441 of the notification plate 44 easily through the window 45 while operating the operation handle 34.

The notification plate 44 and the window 45 are positioned relative to each other in the following manner. In the state where the tip 42P of the movable member 42 is on the virtual nip line NL as illustrated in FIG. 3A, the first colored section 44A included in the colored portion 441 of the notification plate 44 faces the window 45. In the state where the tip 42P of the movable member 42 is on the side nearer to the first transport member 311 and off the virtual nip line NL as illustrated in FIG. 3B, the second colored section 44B included in the colored portion 441 of the notification plate 44 faces the window 45.

Figure 4A:
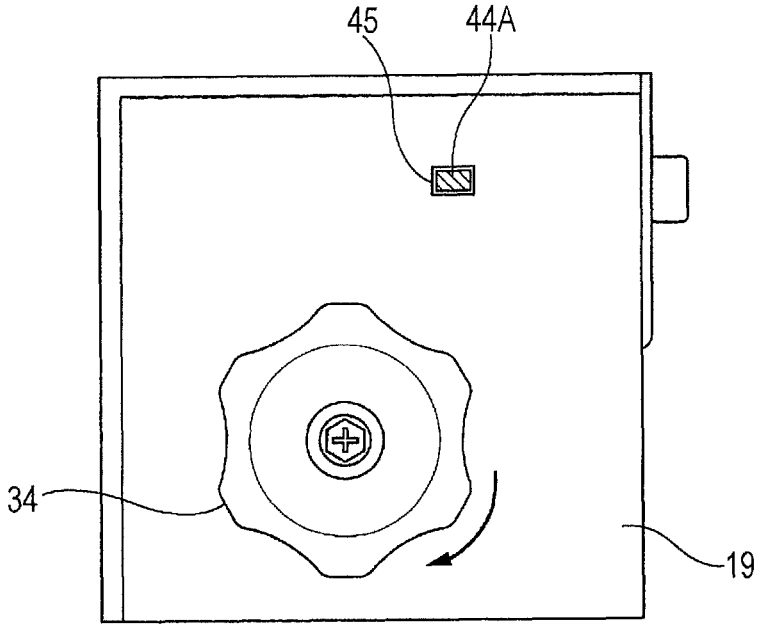
FIGS. 4A and 4B illustrate a notification plate and a window included in a notification mechanism.
Figure 4B:
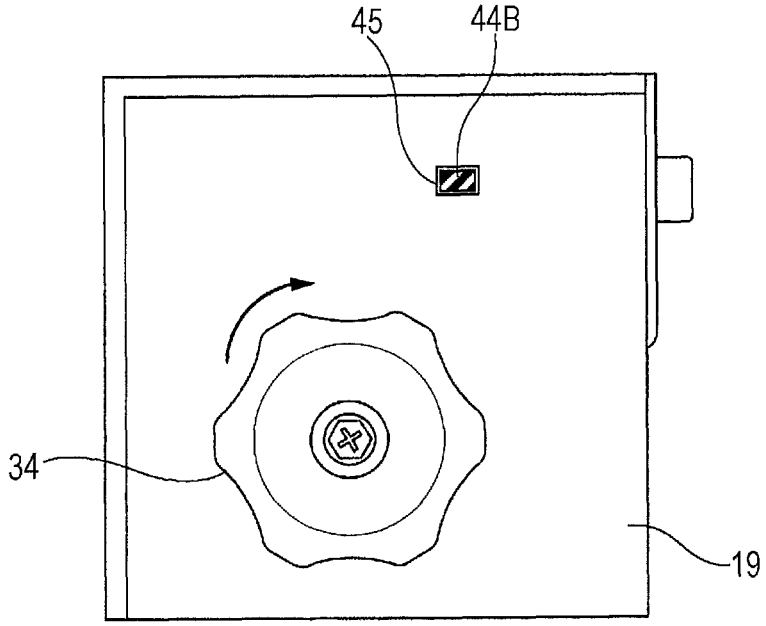

FIGS. 4A and 4B illustrate the notification plate 44 and the window 45 included in the notification mechanism 40.

A case where a sheet P has been jammed in the sheet passage 31P of the sheet transport portion 30 will now be described.

To remove the sheet P jammed in the sheet passage 31P, the user rotates the operation handle 34 as illustrated in FIG. 4A. With the rotation of the operation handle 34, the transport shaft 323 illustrated in FIG. 2 rotates. Accordingly, the first transport roller 321 and the second transport roller 322 provided on the transport shaft 323 rotate, whereby the sheet P is moved.

In such a situation, the user is not able to directly observe the state of the sheet P located in the image forming apparatus 1 but is able to observe the notification plate 44 through the window 45 as illustrated in FIG. 4A. In the above situation, the sheet P in the image forming apparatus 1 is nipped at the sheet nipping parts 31N as illustrated in FIG. 3A. That is, the tip 42P of the movable member 42 is in contact with the sheet P and is on the virtual nip line NL. Such a state is represented by the first colored section 44A colored in red, and the first colored section 44A is observable through the window 45 from the outside of the image forming apparatus 1 as illustrated in FIG. 4A.

Subsequently, when the user further rotates the operation handle 34 as illustrated in FIG. 4B, the sheet P comes out of the sheet nipping parts 31N as illustrated in FIG. 3B. Accordingly, the tip 42P of the movable member 42 moves away from the sheet P. The movable member 42 is subject to the force exerted by the torsion spring 43 provided on the transport shaft 323, the force acting toward the first transport member 311. Hence, when the sheet P has come out of the sheet nipping parts 31N, the movable member 42 rotates about the transport shaft 323 serving as the axis of rotation thereof, whereby the tip 42P moves toward the first transport member 311 and away from the virtual nip line NL. With the rotation of the movable member 42, the notification plate 44 rotates.

Such a state is represented by the second colored section 44B colored in blue in the exemplary embodiment, and the second colored section 44B is observable through the window 45 from the outside of the image forming apparatus 1 as illustrated in FIG. 4B. In this manner, the user is allowed to observe, through the window 45, the change of the color from red corresponding to the first colored section 44A to blue corresponding to the second colored section 443. Thus, the user knows whether or not the sheet P has come out of the sheet nipping parts 31N. That is, the user is notified whether or not the jammed sheet P has been removed by the rotation of the operation handle 34.

In the exemplary embodiment, if a sheet P is jammed in, for example, the sheet passage 31P and the user rotates the operation handle 34 so as to remove the sheet P from the sheet nipping parts 31N, the sheet P is moved to a position out of the sheet nipping parts 31N by the user's operation of the operation handle 34. Consequently, the movable member 42 and the notification shaft 41 are activated, and the notification plate 44 notifies the completion of the operation of the operation handle 34 through the window 45. Thus, the completion of the operation of the operation handle 34 is notified on the basis of the position of the sheet P that is made to come out of the sheet nipping parts 31N by the user's operation of the operation handle 34.

In this manner, the notification mechanism 40 allows the user to know, from the outside of the image forming apparatus 1, the state of the sheet P at the sheet nipping parts 31N located inside the image forming apparatus 1 that is not directly observable unless the body of the image forming apparatus 1 is opened. That is, the user is allowed to know how much the operation handle 34 needs to be rotated so as to complete the removal of the sheet P from the sheet nipping parts 31N.

While the exemplary embodiment concerns a case where the operation handle 34 and the notification mechanism 40 are provided in the sheet transport portion 30, the present invention is not limited to such a case. For example, the operation handle 34 and the notification mechanism 40 are applicable to any path of the sheet P that is yet to undergo the image forming operation or to any path of the sheet P that has undergone the image forming operation.

Moreover, the operation handle 34 and the notification mechanism 40 are not limited to be provided at positions where the jammed sheet P is not directly observable. For example, in a case where a sheet P jammed at a lower portion of the image forming apparatus 1 is to be removed, the operation handle 34 and the notification mechanism 40 may be provided at respective positions where it is difficult for the user to check the state of the jammed sheet P while operating the operation handle 34. Thus, the user is allowed to know whether or not the removal of the jammed sheet P has been complete. Hence, the operation handle 34 is operated to an appropriate extent.

While the exemplary embodiment concerns a case where the notification plate 44 and the window 45 in combination notify the user that the removal of the jammed sheet P has been complete, the present invention is not limited to such a case. For example, two kinds of lamps that operate in accordance with the movement of the notification shaft 41 that rotates with the movement of the movable member 42 may be provided. In such a configuration, when a sheet P is nipped at the sheet nipping parts 31N, one of the lamps that has, for example, a red color may be turned on; when no sheet P is nipped at the sheet nipping parts 31N, the other lamp that has, for example, a green color may be turned on. Alternatively, a predetermined text message or image may be displayed on the user interface (UI) 16 of the image forming apparatus 1 in conjunction with the movement of the movable member 42.

In the exemplary embodiment, the notification shaft 41 mechanically rotate with the aid of the movable member 42 in conjunction with the movement of the sheet P, and the state of the notification plate 44 changes with the rotational movement of the notification shaft 41. Hence, for example, there is no need to provide a separate electronic sensor or to establish an operation of controlling the display of any image as a notification. Thus, the completion of the operation of the operation handle 34 is notified with a simple configuration.

While the exemplary embodiment concerns a case where the user directly rotates the operation handle 34 so as to rotate the transport shaft 323 of the transport roller unit 32, the present invention is not limited to such a case. The present invention is applicable to a case where a jammed sheet P is removed on the basis of any operation of the operation handle 34 that is directly performed by the user, not an automatic removal of a jammed sheet P on the basis of a control operation performed by the image forming apparatus 1. For example, a driving motor that causes the operation handle 34 to rotate, and a switch or the like that allows the user to operate the driving motor at the user's discretion may be provided. In such a configuration, the transport roller unit 32 may be operated in conjunction with the operation handle 34 that is rotated when the user operates the switch.

While the exemplary embodiment employs a configuration in which the movable member 42 and the notification plate 44 are provided on the notification shaft 41 and the completion of the removal of the jammed sheet P is notified in conjunction with the rotational movement of the notification shaft 41, the present invention is not limited to such a configuration. For example, the movable member 42 may be linearly movable in such a manner as to be advanceable into and retractable from the sheet P in accordance with the state of contact or noncontact with the sheet P that is in the sheet nipping parts 31N. Furthermore, a notification member whose state of notification changes in accordance with the position of the movable member 42 may be provided. Thus, the completion of the removal of the jammed sheet P may be notified of to the user.

In the exemplary embodiment, since the movable member 42 is positioned in the sheet passage 31P, the movable member 42 that is rotatable rotates when the sheet P comes into contact with the movable member 42. Thus, the probability that the movable member 42 hinders the transport of the sheet P is reduced.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section that forms an image;

a transport path section along which a recording material that is yet to undergo or has undergone image formation performed by the image forming section is transported;

a transport unit that is provided in the transport path section and transports the recording material while nipping the recording material;

an operated portion that is operated by a user and activates the transport unit such that the recording material is removed from the transport unit; and a notification unit that notifies a completion of the operation of the operated portion on the basis of a position of the recording material that is removed from the transport unit by the user's operation of the operated portion, the notification unit including a movable portion that is advanceable into and retractable from the transport path section and is movable along a locus passing through a position, in a direction of transport of the recording material, where the transport unit is provided, the movable portion being provided on a rotatable shaft, and a notification member that notifies a user of a state of the notification unit based on the movement of the movable portion, the notification member rotating with the rotation of the rotatable shaft.

2. The image forming apparatus according to claim 1, wherein the notification member is provided adjacent to the operated portion.

3. A recording-material-transporting device comprising:

a transport path section along which a recording material is transported;

a transport unit that is provided in the transport path section and transports the recording material while nipping the recording material;

an operated portion that is operated by a user and activates the transport unit such that the recording material is removed from the transport unit; and a notification unit that notifies a completion of the operation of the operated portion on the basis of a position of the recording material that is removed from the transport unit by the user's operation of the operated portion, the notification unit including a movable portion that is advanceable into and retractable from the transport path section and is movable along a locus passing through a position, in a direction of transport of the recording material, where the transport unit is provided, the movable portion being provided on a rotatable shaft, and a notification member that notifies a user of a state of the notification unit based on the movement of the movable portion, the notification member rotating with the rotation of the rotatable shaft.

* * * * *